US009891558B2

(12) United States Patent
Matsushita et al.

(10) Patent No.: US 9,891,558 B2
(45) Date of Patent: Feb. 13, 2018

(54) SEMICONDUCTIVE RESIN COMPOSITION, MEMBER FOR ELECTROPHOTOGRAPHY AND IMAGE FORMING APPARATUS

(71) Applicants: Makoto Matsushita, Tokyo (JP); Akira Izutani, Osaka (JP); Hiroaki Takahashi, Kanagawa (JP); Yuri Haga, Kanagawa (JP); Keiichiro Juri, Kanagawa (JP); Hideaki Yasunaga, Tokyo (JP)

(72) Inventors: Makoto Matsushita, Tokyo (JP); Akira Izutani, Osaka (JP); Hiroaki Takahashi, Kanagawa (JP); Yuri Haga, Kanagawa (JP); Keiichiro Juri, Kanagawa (JP); Hideaki Yasunaga, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 132 days.

(21) Appl. No.: 14/974,269

(22) Filed: Dec. 18, 2015

(65) Prior Publication Data

US 2016/0202639 A1 Jul. 14, 2016

(30) Foreign Application Priority Data

Jan. 9, 2015 (JP) ..... 2015-003187

(51) Int. Cl.
*H01B 1/12* (2006.01)
*G03G 15/01* (2006.01)
(Continued)

(52) U.S. Cl.
CPC ..... *G03G 15/162* (2013.01); *G03G 15/1685* (2013.01); *H01B 1/24* (2013.01)

(58) Field of Classification Search
None
See application file for complete search history.

(56) References Cited

U.S. PATENT DOCUMENTS 6,610,766 B1 * 8/2003 Kitamura ..... C03C 17/32 428/364
2006/0172097 A1 * 8/2006 Morikoshi ..... G03G 5/10 428/35.7

(Continued)

FOREIGN PATENT DOCUMENTS

JP 4-255332 9/1992

OTHER PUBLICATIONS

U.S. Appl. No. 14/731,556, filed Jun. 5, 2015.

*Primary Examiner* — Katie L Hammer
(74) *Attorney, Agent, or Firm* — Cooper & Dunham LLP

(57) ABSTRACT

A semiconductive resin composition includes a plurality of thermoplastic resins forming a sea-island structure including a sea portion and an island portion; and a plurality of conductive fillers. The sea portion includes at least two of the thermoplastic resins, at least one of the at least two of the thermoplastic resins is a copolymer, and the content of the copolymer is from 20% to 60% by weight per 100% by weight of the thermoplastic resins in the sea portion, and the following relation is satisfied:

$$1.5 \leq B/A \leq 10$$

wherein A represents an average primary particle diameter of one of the conductive fillers having the smallest average primary particle diameter and B represents an average primary particle diameter of one of the conductive fillers having the largest average primary particle diameter.

9 Claims, 4 Drawing Sheets

(51) Int. Cl.
*G03G 15/16* (2006.01)
*H01B 1/24* (2006.01)

(56) References Cited

U.S. PATENT DOCUMENTS

| | | | | |
|---|---|---|---|---|
| 2009/0142107 | A1 | 6/2009 | Akira et al. | |
| 2009/0279909 | A1 | 11/2009 | Matsushita et al. | |
| 2009/0324270 | A1 | 12/2009 | Yamashita et al. | |
| 2010/0173108 | A1* | 7/2010 | Nagao | C08K 3/04 428/36.9 |
| 2011/0008069 | A1 | 1/2011 | Matsushita et al. | |
| 2011/0217653 | A1 | 9/2011 | Izutani et al. | |
| 2011/0243616 | A1 | 10/2011 | Nakagawa et al. | |
| 2011/0249994 | A1 | 10/2011 | Matsushita et al. | |
| 2012/0237270 | A1 | 9/2012 | Juri et al. | |
| 2012/0294657 | A1 | 11/2012 | Matsushita et al. | |
| 2012/0315067 | A1 | 12/2012 | Takahashi | |
| 2013/0058685 | A1 | 3/2013 | Juri et al. | |
| 2014/0212184 | A1 | 7/2014 | Juri et al. | |
| 2014/0243465 | A1 | 8/2014 | Matsushita et al. | |
| 2014/0321888 | A1 | 10/2014 | Yasunaga et al. | |
| 2015/0014602 | A1 | 1/2015 | Matsushita et al. | |
| 2015/0078777 | A1 | 3/2015 | Juri et al. | |
| 2015/0078790 | A1 | 3/2015 | Ishikawa et al. | |
| 2015/0078791 | A1 | 3/2015 | Momose et al. | |

* cited by examiner

SEMICONDUCTIVE RESIN COMPOSITION, MEMBER FOR ELECTROPHOTOGRAPHY AND IMAGE FORMING APPARATUS

CROSS-REFERENCE TO RELATED APPLICATIONS

This patent application is based on and claims priority pursuant to 35 U.S.C. §119 to Japanese Patent Application No. 2015-003187, filed on Jan. 9, 2015, in the Japan Patent Office, the entire disclosure of which is hereby incorporated by reference herein.

BACKGROUND

Technical Field

The present invention relates to a semiconductive resin composition, a member for electrophotography and an image forming apparatus.

Description of the Related Art

As one of members for electrophotography for use in an electrophotographic image forming apparatus, an intermediate transfer belt formed of a semiconductive resin is known. Recently, image forming apparatuses have been required to have lower cost, and the intermediate transfer belt is required to have lower cost as well. At the same timer, the intermediate transfer belt needs to ensure image quality and durability.

However, it is difficult to control resistance in a semiconductive area while maintaining mechanical properties and durability in variation of environment. Particularly, although extrusion molding with a thermoplastic resin is advantageous to cost reduction because of being capable of producing continuously, resistance deviation in a circumferential direction of the belt due to the die tends to be large.

In order to solve this problem, a method of blowing a gas again from an outer circumference of the tube near the upper end of the mandrel where an extruded tube is most deformed such that the outer circumferential temperature is close to that of the mandrel to control the surface resistance level of the endless belt to be not greater than ±1 order is disclosed.

However, a new device blowing an outer gas from the outer circumference increases production facilities and complicates production process, resulting in cost increase. Therefore, cost reduction is not achieved.

Meanwhile, when the resistance deviation in a circumferential direction is large, a first transfer and a second transfer are difficult to execute at a high resistance portion, resulting in production of defective images. The resistance deviation in a circumferential direction is not sufficiently reduced by conventional technologies. Therefore, a semiconductive resin composition suppressing the resistance deviation is desired.

SUMMARY

A semiconductive resin composition including a plurality of thermoplastic resins forming a sea-island structure including a sea portion and an island portion; and a plurality of conductive fillers, wherein the sea portion includes at least two of the thermoplastic resins, at least one of the at least two of the thermoplastic resins is a copolymer, and the content of the copolymer is from 20% to 60% by weight per 100% by weight of the thermoplastic resins in the sea portion, and the following relation is satisfied:

$$1.5 \leq B/A \leq 10$$

wherein A represents an average primary particle diameter of one of the conductive fillers having the smallest average primary particle diameter and B represents an average primary particle diameter of one of the conductive fillers having the largest average primary particle diameter.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
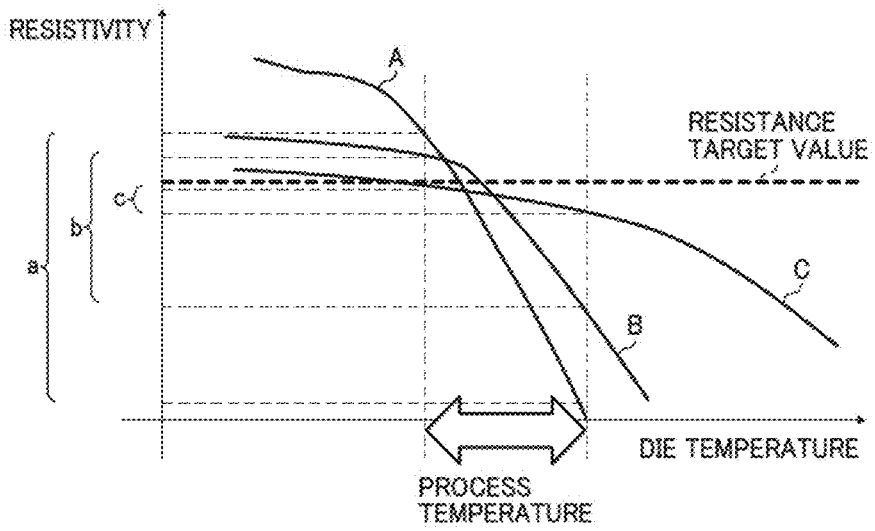
FIG. 1 is a diagram for explaining variation of resistance properties.

Accordingly, one object of the present invention is to provide a semiconductive resin composition capable of reducing resistance deviation in a circumferential direction at low cost.

Another object of the present invention is to provide a member for electrophotography using the semiconductive resin composition.

A further object of the present invention is to provide an image forming apparatus using the member for electrophotography.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The present invention relates to a semiconductive resin composition, including a thermoplastic resin comprising a sea-island structure; and plural conductive fillers, wherein the thermoplastic resin in the sea portion comprises plural resins comprising at least one copolymer, the content of which is from 20% to 60% by weight per 100% by weight of the thermoplastic resin in the sea portion, and the following relation is satisfied:

$$1.5 \leq B/A \leq 10$$

wherein A represents an average primary particle diameter of the conductive filler having the smallest average primary particle diameter and B represents an average primary particle diameter of the conductive filler having the largest average primary particle diameter.

The thermoplastic resin has a sea-island structure, and the thermoplastic resin in the sea portion is called a mother resin as well. When the thermoplastic resins in the sea and island portions and the conductive filler are melted, kneaded and extrusion-molded, decreasing dependency of the surface resistivity on the molding temperature is one of the features of the present invention by controlling the kneading conditions, selecting the conductive filler, etc. In addition, decreasing resistance of the island portion is thought one of elements to decrease dependency on the molding temperature.

In the present invention, the semiconductive resin composition has a surface resistivity of from $1\times10^{5}$ to $1\times10^{13}\Omega/\square$.

The semiconductive resin composition of the present invention is preferably used for electrophotographic members such as an intermediate transfer belt, which is preferably a seamless belt.

(Semiconductive Resin Composition)

The semiconductive resin composition includes at least a thermoplastic resin having a sea-island structure and plural conductive fillers. The thermoplastic resin in the sea portion includes plural resins including at least one copolymer, the content of which is from 20% to 60% by weight per 100% by weight of the thermoplastic resin in the sea portion. When less than 20% by weight, the resistivity deviation deteriorates.

When greater than 60% by weight, the mechanical strength elasticity deteriorates. A belt applied with a tensile strength from inside through a roller when produced has creep and elongation, resulting in image noise and color shift.

In addition, the following relation is satisfied:

$$1.5\leq B/A\leq 10$$

wherein A represents an average primary particle diameter of the conductive filler having the smallest average primary particle diameter and B represents an average primary particle diameter of the conductive filler having the largest average primary particle diameter.

This range facilitates controlling the surface resistivity and decreases unevenness thereof. When out of this range, controlling the surface resistivity is difficult and unevenness thereof increases.

The above composition decreases the resistance deviation in a circumferential direction without a conventional device blowing an outer gas from the outer circumference. In addition, even a semiconductive area can be controlled to have a desired surface resistivity while unevenness thereof is suppressed. Further, variation of the resistance less depends on molding temperature.

The conductive filler is present in the sea and island portions of the thermoplastic resin. In an areal ratio of the cross-section, 25% to 60% of the conductive filler is preferably present in the thermoplastic resin in the island portion in the sea-island structure to further suppress the resistance deviation.

The areal ratio is determined as follows. A cross section of a sample is formed by apparatuses using a convergence ion beam (FIB), cryomicrotome, ion milling, a freeze fracture method, etc. and observed with a scanning transmittance electron microscope (STEM), etc. to see the sea-island structure and determine the areal ratio of the conductive filler. In some cases, Ru dyeing, osmium dyeing, phosphorus tungstic acid dyeing, etc. may be applied to more clearly see the sea-island structure according to the resins. Thus, a ratio of an area of the conductive filler present in the island portion to an area thereof in both of the sea and island portions is determined.

<Resistance Properties>

FIG. 1 is a diagram for explaining resistance properties. FIG. 1 is a diagram showing variation of resistance properties of various samples according to molding temperature. In FIG. 1, a horizontal axis is temperature of a die used for molding the semiconductive resin composition, and a vertical axis is a common logarithm value of the surface resistivity of the semiconductive resin composition (hereinafter referred to as "resistance").

In FIG. 1, "resistance target value" is 11, and a "molding temperature range" is a die temperature when molding the semiconductive resin composition. A width of the process temperature represents unevenness of the molding temperature.

<<Large Deviation (FIG. 1A)>>

An example of resistance properties when a resistance deviation is large is shown as A in FIG. 1. A is an example including only a thermoplastic resin and a conductive filler. The thermoplastic resin does not have a sea-island structure. In a molding method of melting and kneading a thermoplastic resin and a resin including an conductive filler to pour in a die and extruding them, the higher the molding temperature, the lower the surface resistivity. The lower the molding temperature, the higher the surface resistivity. It is thought this is because the conductive filler tends to aggregate due to large heat history when the temperature is high and the resin is highly fluidized. A relation between the surface resistivity and the molding temperature is not a straight line relation, and a curve having an inflection point having a threshold.

Particularly, with only the thermoplastic resin and the conductive filler, the surface resistivity is not less than 13 at a high resistance side, i.e., in a temperature range lower than the process temperature range in FIG. 1, which is unusable as an electrophotographic member. The surface resistivities around 10 to 11 keenly vary, and the influence of uneven molding temperature enlarges the surface resistivity deviation. The surface resistivity deviation is large as "a" in FIG. 1.

<<Middle Deviation (FIG. 1B)>>

B is an example having a sea-island structure including a thermoplastic resin which is a sea of the sea-island structure, a thermoplastic resin which is an island and a non-ionic antistat, and a conductive filler. Although the surface resistivity is higher than a resistance target value in a low molding temperature range, it is lower than the curve of the example of large deviation (FIG. 1A). In addition, an area having small slant exists. It is thought this is because the conductive filler is included in materials for the island portion. When the molding temperature is further increased, an inflection point where the resistance quickly decreases appears and the resistance becomes smaller. The slant is smaller than the example of large deviation (FIG. 1A), but is not satisfactory. The resistance deviation has a width as "b" in FIG. 1 and is smaller than "a", but is not satisfactory.

<<Small Deviation (FIG. 1C)>>

C has the same formulation of materials as B and is an example in which the kneading conditions are changed such that the sea portion includes the conductive filler at a specific ratio and the island portion includes the conductive filler as well. The total resistance is lower than the curve of the example of middle deviation (FIG. 1B) and the slant is smaller as well. When materials having lower resistance are used for the island portion, an area having high resistance and a small slant at low temperature side closes with a desired resistance. Unevenness of the surface resistivity can be smaller compared with that of the molding temperature. The resistance deviation can be decreased to have a width as "c" in FIG. 1.

<Behavior of Thermoplastic Resin and Conductive Filler>

FIGS. 2A to 2D are schematic views for explaining behaviors of the thermoplastic resin and the conductive filler. In FIGS. 2A to 2D, numeral 5 represents a conductive filler, and numerals 6*a* to 6*c* represent resins of a substrate, an island portion and a sea portion, respectively.

Figure 2A:
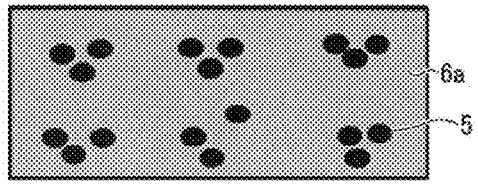
FIGS. 2A to 2D are schematic views for explaining behaviors of the thermoplastic resin and the conductive filler.

FIG. 2A is a schematic view for explaining the large deviation (FIG. 1A). Fine dispersion of the conductive filler is difficult when dispersed in melting and kneading the thermoplastic resin. Hopping forms a conductive path, and aggregation state of the conductive filler varies because of having larger voltage dependency or electrification deterioration, resulting in fluctuation of the resistance. In addition, the molding temperature largely varies the surface resistivity, resulting in larger deviation in consideration of unevenness of the process temperature.

Figure 2B:
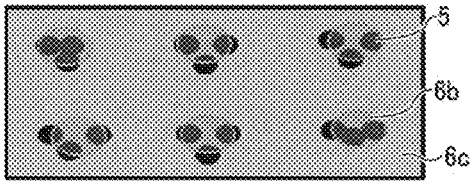

FIG. 2B is a schematic view for explaining the middle deviation (FIG. 1B). A thermoplastic resin which is a second conductive resin is included in the thermoplastic resin to form a sea-island structure. The conductive filler is present in the island portion to decrease voltage dependency thereof, and the aggregation state thereof is difficult to vary because of being covered with a resin in the island portion. Therefore, the resistance becomes easy to be stable. However, although the molding temperature slight decreases variation of the surface resistivity, the deviation is not satisfactory.

Figure 2C:
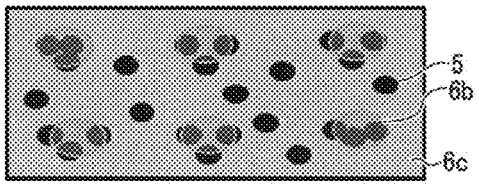

FIG. 2C is a schematic view for explaining the small deviation (FIG. 1C). When the thermoplastic resin has a sea-island structure, the island portion includes the conductive filler and the sea portion includes the conductive filler at a specific ratio, the surface resistivity has a smaller slant compared with that of the molding temperature. Therefore, a seamless belt having small deviation is obtained.

Figure 2D:
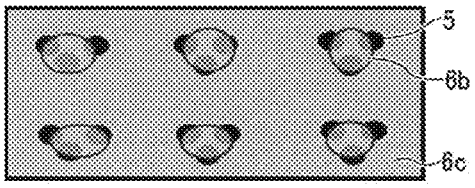

FIG. 2D is a schematic view for explaining the small deviation (FIG. 1C), focusing the island portion. When materials for the island have lower resistance, the high resistance area at a side of low molding temperature decreases in resistance, which has thermostability and less unevenness. In FIGS. 2D and 2B, materials for the islands are different from each other in resistivity, and the difference suppresses the resistance deviation as well.

<Thermoplastic Resin>

Two thermoplastic resins have sea-island structures, and therefore the sea portion is constituted of a resin forming a substrate of the semiconductive resin composition. Meanwhile, the island portion is preferably constituted of a resin having high electroconductivity. In the present invention, the contents of the sea and the island portions are changeable when necessary, e.g., the content of the resin in the island portion is preferably from 3% to 10% by weight based on total weight of the resin.

The thermoplastic resin in the sea portion includes plural resins including at least one copolymer.

Specific examples of the resins in the sea portion include polyvinylidene fluoride (PVDF) resins, polyethylene resins, polypropylene resins, polystyrene resins, thermoplastic polyamide (PA) resins, acrylonitrile-butadiene-styrene (ABS) resins, thermoplastic polyacetal (POM) resins, thermoplastic polyarylate (PAR) resins, thermoplastic polycarbonate (PC) resins, thermoplastic urethane resins, polyethylene naphthalate (PEN) resins, polybutylene naphthalate (PBN) resin, polyalkylene terephthalate resin and polyester-based resin, etc.

Among these, resins having high elasticity, high fold resistance and incombustibility are preferably used. Particularly, polyvinylidene fluoride (PVDF) resin is preferably used. Polyvinylidene fluoride preferably has a weight-average molecular weight of from 100,000 to 500,000 to have moldability.

Methods of measuring the weight-average molecular weight are not particularly limited, and can be measured by, e.g., gel permeation chromatography (GPC).

The above copolymers include polyvinylidene fluoride copolymer, polypropylene copolymer, etc. The content of the copolymer is from 20 to 60 parts by weight per 100 parts by weight of the thermoplastic resin in the sea portion. When the range mentioned above is not satisfied, a satisfactory resistivity deviation is not obtained.

In addition, one of the thermoplastic resins in the sea portion is a polyvinylidene fluoride, and the above copolymer has vinylidene fluoride and hexafluoropropylene as a structural unit and preferably includes hexafluoropropylene in an amount of from 5% to 10% by weight.

The copolymer having vinylidene fluoride and hexafluoropropylene as a structural unit is a copolymer of a polymer of vinylidene fluoride having the following formula (1) and hexafluoropropylene having the following formula (2). The structure of the copolymer is not particularly limited, and a block copolymer, a random copolymer, etc. can be used. n and m in the following formulae (1) and (2) are arbitrary natural numbers.

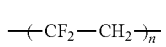

(1)

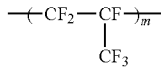

(2)

The copolymer preferably includes hexafluoropropylene in an amount of from 5% to 10% by mol to further suppress the resistance deviation.

The copolymer of polyvinylidene fluoride or vinylidene fluoride and hexafluoropropylene may be a pellet or a powder. The powder may be better if dispersibility is preferred.

The copolymer of polyvinylidene fluoride has a melting point Tm about from 120° C. to 160° C. A homopolymer (polymer of vinylidene fluoride) has a melting point Tm about from 150° C. to 170° C. The copolymer has a melting point lower than that of the homopolymer. This is because the copolymer has a branched chain hindering crystallization and is easy to move.

Blended with a homopolymer, the high the melting point of the copolymer, the higher the viscosity and the smaller the crystallization. Therefore, the conductive filler and materials for the island portion have good dispersibility or are difficult to reaggregate. Particularly, when the melting point is from 140° C. to 160° C., the viscosity is high, the dispersibility is improved and the resistance deviation can be decreased.

The melting point Tm can be measured by a differential scanning calorimeter (DSC) such as DSC-6220R from Seiko Instruments Inc. The measuring conditions can suitably be changeable.

Known thermoplastic resins can be used as the resin in the island portion, and the resin in the sea portion can be used as well. The resin in the island portion preferably has high electroconductivity, and a known polymeric antistat can be used therein. Specific examples of the polymeric antistat include known materials such as polyether-ester amides, ethylene oxide-epichlorohydrins, polyether esters and polystyrene sulfonates. Particularly, a block copolymer having a polyalkylene unit is preferably used.

The thermoplastic resins in the island portion is preferably a block copolymer having a polyalkylene unit and a saturated moisture absorption quantity not greater than 3% to suppress bleed out.

The saturated moisture absorption quantity is measured by a Carl Fischer moisture meter (vaporization temperature 160° C.) under conditions of 23° C., 50% RH and a moisture absorption time of 48 hrs. When the saturated moisture absorption quantity is not less than 3%, hydrolysis occurs in molding and the polyalkylene unit decreases in molecular weight, and bleed out may occur in storage test. In this case, hot air drying at 95° C. for 6 hrs, molding at low humidity, nitrogen substitution, low-temperature molding, etc. are needed, resulting in low productivity.

The polyalkylene unit preferably includes polypropylene to suppress bleed out and resistivity deviation.

<Conductive Filler>

Metal oxides, carbon black and known conductive fillers can be used as the conductive filler. Specific examples of the metal oxides include zinc oxide, tin oxide, titanium oxide, zirconium oxide, aluminum oxide, silicon oxide, etc. In addition, the above metal oxide subjected to surface treatment beforehand is used to improve dispersibility.

Among the conductive fillers, carbon black is preferably used.

Specific examples of the carbon black include conductive carbons such as KETJEN BLACK and acetylene black; carbons for rubber such as SAF, ISAF, HAF, FEF, GPF, SRF, FT and MT; oxidized carbons for color ink; thermolysis carbon; natural graphite; artificial graphite; conductive furnace black; superconductive furnace black; extraconductive furnace black; and conductive channel black.

Specific examples of the conductive carbon blacks include CONTINEX CF from Continental Carbon Co., KETJEN BLACK EC from Ketjen Black International, VULCAN C which is conductive furnace black from by Cabot Corp., BLACK PEARLS® 2000 which is conductive furnace black from by Cabot Corp., DENKA BLACK which is acetylene black from Denka Company Limited.

Specific examples of the other carbon blacks include, but are not limited to, Toka Black #4300, #4400, #4500 and #5500 which are furnace blacks from Tokai Carbon Corporation; PRINTEX L which is furnace black from Degussa AG Corporation; Raven7000, 5750, 5250, 5000ULTRAIII, 5000ULTRA, Conductex SC ULTRA, 975 Conductex ULTRA PUER BLACK100, 115 and 205 which are furnace blacks from Columbian Chemicals Co.; #2350, #2400B, #2600B, #3050B, #3030B, #3230B, #3350B, #3400B and #5400B which are furnace blacks from Mitsubishi Chemical Corp.; MONARCH1400, 1300 and 900, VulcanXC-72R and BLACK PEARLS® 2000 which are furnace blacks from Cabot Corp.; Ensaco250G, Ensaco260G and Ensaco350G and SuperP-Li from TIMCAL Corporation; KETJEN BLACK EC-300J and EC-600JD from Akzo Nobel N.V.); and DENKA BLACK, DENKA BLACK HS-100 and FX-35 which are acetylene blacks from Denka Company Limited.

Besides the carbon blacks, inorganic particulate materials of metals and metal oxides such as tin oxide, titanium oxide, zinc oxide, nickel and copper can be used.

<Method of Preparing the Semiconductive Resin Composition>

Specific examples of a method of preparing the semiconductive resin composition of the present invention include, but are not limited to, melting and kneading a thermoplastic resin and an conductive filler to disperse the conductive filler in the resin, and extrusion-molding them. Methods of melting, kneading and molding are explained.

<<Methods of Melting and Kneading>>

Specific examples of the melting and kneading apparatus include, but are not limited to, any known kneaders, e.g., biaxial kneaders such as KTK from Kobe Steel, Ltd., TEM from Toshiba Machine Co., Ltd., TEX from Japan Steel Works, Ltd., PCM from Ikegai Co., Ltd. and KEX from Kurimoto Ltd.; and monoaxial kneaders such as KO-KNEADER from Buss Corporation.

The dispersion status of the conductive filler changes according to the dispersion conditions. While a ratio of the thermoplastic resin constituting the island portion is larger than that of the resin constituting the sea portion, the conductive filler having small particle diameter is kneaded. Next, the resin constituting the sea portion and the conductive filler having small particle diameter are kneaded. These are mixed and extrusion-molded such that the island portion takes the small conductive filler in, and the other conductive fillers are difficult to take in and likely to be present in the sea portion.

The kneading methods are not limited thereto, and after the thermoplastic resin constituting the island portion and the conductive filler are kneaded, a mixture of the thermoplastic resin constituting the island portion and the conductive filler having large or small particle diameter are kneaded. These are mixed with the resin constituting the sea portion and extrusion-molded to obtain a desired status. According to acidity, oil absorption and ashes of materials for the island portion and the conductive filler, resins and conductive fillers difficult or easy to take in the island portion can be used. These maybe combined. The dispersibility of the conductive filler in the resin of the sea portion may be different from that in the resin of the island portion. When all the materials are put in once, the conductive filler may unevenly be distributed in either of the resins and an amount thereof may be uncontrollable.

In order to avoid such uneven distribution, the conductive filler may be separately kneaded with each of the resins to prepare pellets, and the pellets may be mixed together. Namely, a process of melting and kneading the thermoplastic resin constituting the sea portion of the sea-island structure and the conductive filler to prepare a pellet A, a process of melting and kneading the thermoplastic resin constituting the island portion of the sea-island structure and the conductive filler to prepare a pellet B, and a process of melting and kneading the pellets A and B to be extrusion-molded may be combined.

<<Molding Method>>

After melted and kneaded as mentioned above, the kneaded mixture is processed by a molding processor to have a desired shape. Known molding processors can be used as the molding processor for use in the present invention. For example, an extrusion molder can mold a cylindrical member such as intermediate transfer belts.

Figure 3:
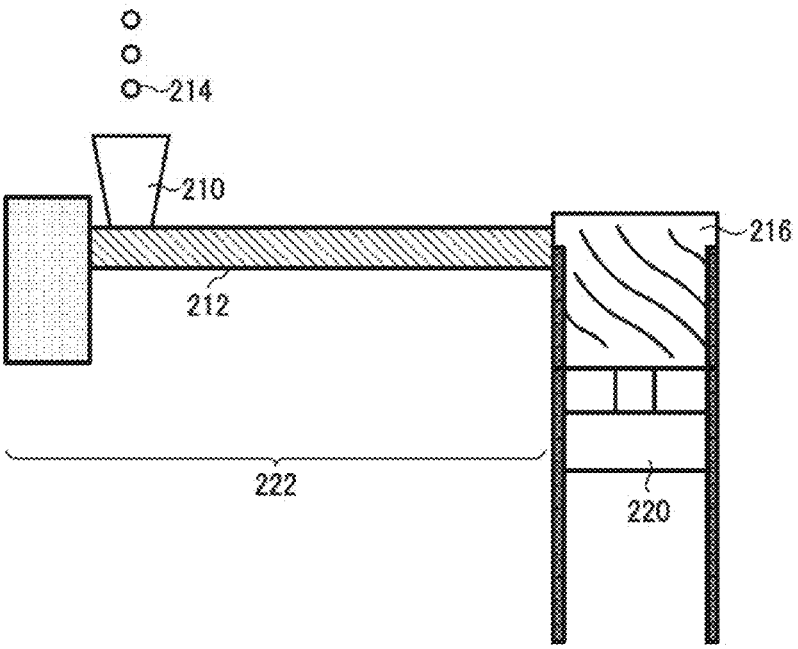
FIG. 3 is a schematic view illustrating an embodiment of extrusion molder.

FIG. 3 is a schematic view illustrating an embodiment of the extrusion molder. The extrusion molder in FIG. 3 includes a hopper 210, a screw 212, a compound 214, a mandrel die 216, an inner core (sizing die) 220 and an extruder 222.

An example of the molding method is explained. The compound 214 is put from the hopper 210, and the temperature of the screw 212 is adjusted such that a resin is sufficiently fed into the mandrel die 216. A cylindrical film is extruded from the die when the temperature of the die is higher than a melting point of the thermoplastic resin. The extruded resin is cooled by the sizing die 220. The cylindrical film is drawn with an inner and outer rollers.

The melted resin extruded from the extruder 222 is poured into the cylindrical the mandrel die 216 to prepare a seamless belt. The resin extruded from the extruder 222 may be poured into a spiral die in which flow paths are divided into 8 and join together to spirally flow the resin. Besides, a coat hanger die in which flow paths are not divided and the resin moves round and joins at one point can be used. Then, the resin flows out from a lip. The belt is molded through the inner core to decide a peripheral length and a shape thereof and drawn while put between rollers.

(Image Forming Apparatus)

The image forming apparatus of the present invention includes at least an electrostatic latent image bearer (hereinafter referred to as a "photoconductor"), an electrostatic latent image former, an image developer and a transferer, and other means when necessary. The image forming apparatus of the present invention includes the member for electrophotography of the present invention. The member for electrophotography is an intermediate transfer belt, and the transfer preferably includes the intermediate transfer belt.

Figure 4:
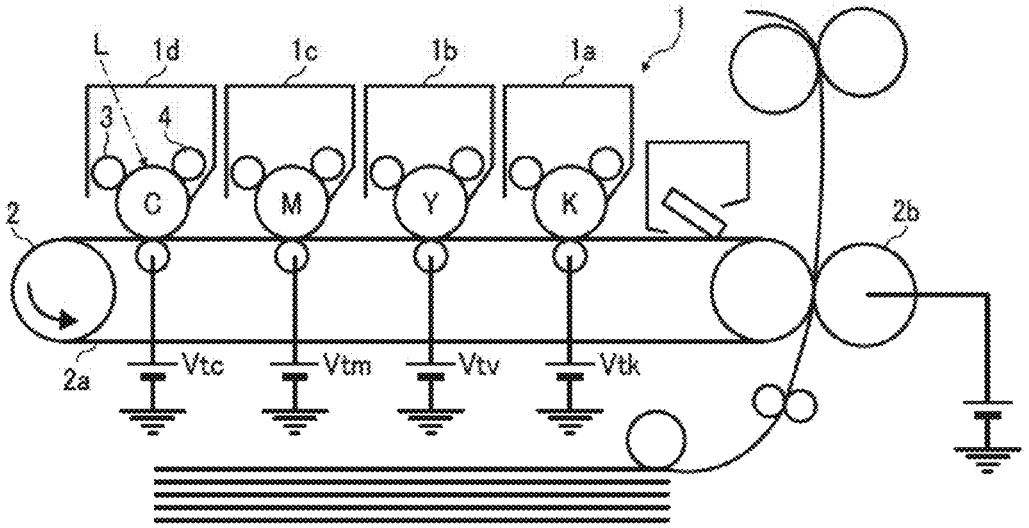
FIG. 4 is a schematic view illustrating an embodiment of the image forming apparatus of the present invention.

FIG. 4 is a schematic view illustrating an embodiment of the image forming apparatus of the present invention. FIG. 4 represents an outline of a color laser printer. After a photoconductor is charged by a charging roller 3 in a process cartridge 1 and irradiated to form an electrostatic latent image thereon, a toner in the cartridge is charged by a developing roller 4 and the electrostatic latent image is developed therewith by an image developer to form a toner image. The toner image is first transferred onto an intermediate transfer belt 2*a* through a magnetic field, which is applied with a bias to form the magnetic field in order of black, yellow, magenta and cyan while overlapped. The toner image is second transferred onto a second transfer member 2*b* through a magnetic field as well. Then, the toner melted with heat is fixed on a transfer material by a fixer. The toner remaining untransferred on the second transfer member 2*b* is collected by a cleaning member.

Another embodiment of the image forming apparatus is explained.

The image forming method of the present invention includes at least an electrostatic latent image forming process, a developing process and a transferer process, and other processes when necessary. The image forming method of the present invention uses the member for electrophotography of the present invention. The member for electrophotography is an intermediate transfer belt, and the transfer process preferably uses the intermediate transfer belt.

The image forming method can preferably be executed by the image forming apparatus of the present invention, the electrostatic latent image forming process can preferably be executed by the electrostatic latent image former, the developing process can preferably be executed by the image developer, and the other processes can preferably be executed by the other means.

<Electrostatic Latent Image Former>

The electrostatic latent image former is not particularly limited in materials, structures and sizes, and can be selected from known inorganic photoconductors such as amorphous silicon and selenium, or an organic photoconductors such as polysilane or phthalopolymethine. Amorphous silicon is preferably used terms of long lifespan.

The amorphous silicon photoconductor is formed by heating a substrate at from 50° C. to 400° C. and forming an a-Si photosensitive layer on the substrate by film forming methods such as a vacuum deposition method, a sputtering method, an ion plating method, a heat CVD (Chemical Vapor Deposition) method, a photo CVD method an a plasma CVD method. Particularly, the plasma CVD method is preferably used, which forms an a-Si layer on the substrate by decomposing a gas material with a DC, a high-frequency or a microwave glow discharge.

The electrostatic latent image former is not particularly limited in shape, but preferably has the shape of a cylinder. The cylindrical electrostatic latent image former is not particularly limited in outer diameter, and preferably has an outer diameter of from 3 mm to 100 mm, more preferably from 5 mm to 50 mm, and most preferably from 10 mm to 30 mm.

<Electrostatic Latent Image Former and Electrostatic Latent Image Forming Process>

The electrostatic latent image former is not particularly limited if it forms an electrostatic latent image on the electrostatic latent image bearer, and includes, e.g., a charger charging the surface of the electrostatic latent image bearer and an irradiator irradiating the surface thereof with imagewise light.

The electrostatic latent image forming process is not particularly limited if it is a process of forming an electrostatic latent image on the electrostatic latent image bearer, and includes, e.g., charging the surface of the electrostatic latent image bearer and irradiating the surface thereof with imagewise light with the electrostatic latent image former.

—Charger and Charging Process—

Specific examples of the charger include, but are not limited to, a contact charger equipped with a conductive or semiconductive roller, brush, film, or rubber blade, and a non-contact charger employing corona discharge such as corotron and scorotron.

The charging process is executed by the charger applying a voltage to the surface thereof.

The charger may have the shape of a magnetic brush or a fur brush besides a roller according to the specification and configuration of the image forming apparatus.

The magnetic brush is formed of various ferrite particles such as Zn—Cu ferrite as a charging member, a non-magnetic conductive sleeve and a magnet roll included thereby.

The fur brush is formed of a metallic core wound by a conductive fur with carbon, copper sulfate, metals or metal oxides.

The charger is not limited to the contact charger, but is preferably used because of generating less ozone.

—Irradiator and Irradiation Process—

The irradiator is not particularly limited if it irradiates the charged surface of the electrostatic latent image bearer with imagewise light. Specific examples of the irradiator include, but are not limited to, various irradiators of radiation optical system type, rod lens array type, laser optical type, and liquid crystal shutter optical type.

Specific examples of light sources for use in the irradiator include, but are not limited to, those providing a high luminance, such as light-emitting diode (LED), laser diode (LD), and electroluminescence (EL).

In order to irradiate the electrostatic latent image bearer with light having a wavelength in a desired range, sharp cut filters, bandpass filters, infrared cut filers, dichroic filters, interference filters, color temperature converting filters, and the like can be used.

The irradiation process is executed by the irradiator irradiating the surface of the electrostatic latent image bearer with imagewise light.

In the present invention, it is possible to irradiate the electrostatic latent image bearer from the backside thereof <Image Developer and Developing Process>

The image developer is not particularly limited if it develops the electrostatic latent image formed on the electrostatic latent image bearer with a toner to form a visible image.

The developing process is not particularly limited if it is a process of developing the electrostatic latent image formed on the electrostatic latent image bearer with a toner to form a visible image with the image developer.

The image developer may employ either a dry developing method or a wet developing method. The image developer may employ either a single-color image developer or a multi-color image developer. For example, an image developer which has a stirrer for frictionally charging the developer and a rotatable magnet roller is preferable.

In the image developer, toner particles and carrier particles are mixed and stirred, and the toner particles are charged by friction. The charged toner particles and carrier particles are formed into ear-like aggregation and retained on the surface of the magnet roller that is rotating, thus forming a magnetic brush. Because the magnet roller is disposed adjacent to the electrostatic latent image bearer, a part of the toner particles composing the magnetic brush formed on the surface of the magnet roller migrate to the surface of the electrostatic latent image bearer by an electric attractive force. As a result, the electrostatic latent image is developed with the toner particles to form a visible image on the surface of the electrostatic latent image bearer.

<Transferer and Transfer Process>

The transferer is not particularly limited if it transfers the visible image onto a recording medium, and preferably includes a first transferer transferring the visible image onto an intermediate transferer to form a complex transfer image and a second transferer transferring the complex transfer image onto a recording medium.

The transfer process is not particularly limited if it is a process of transferring the visible image onto a recording medium, and preferably includes firstly transferring the visible image onto an intermediate transferer to form a complex transfer image and secondly transferring the complex transfer image onto a recording medium.

The transfer process is executed by the transferer using a transfer charger charging the photoconductor.

When an image second transferred onto the recording medium is a colored image formed of toners of plural colors, the transferer sequentially overlaps each color toner on the intermediate transferer to form an image, and the intermediate transferer second transfers the image on the recording medium once. Specific examples of the intermediate transferer includes, but are not limited to, an intermediate transfer belt. The member for electrophotography of the present invention is preferably used as the intermediate transfer belt.

The transferer (each of the first transferer and the second transferer) preferably has at least a transfer unit separating and charging the visible image formed on the photoconductor to the side of the recording medium.

Specific examples of the transfer unit include a corona transferer discharging corona, a transfer belt, a transfer roller, a pressure transfer roller, an adhesive transfer unit, etc.

Specific examples of the recording medium typically include, but are not limited to, plain papers if an unfixed image after developed can be transferred to. PET for OHP can also be used.

<Other Means and Other Processes>

The other means include a fixer, a cleaner, a discharger, a recycler, a controller, etc.

The other processes include a fixing process, a cleaning process, a discharge process, a recycle process, a control process, etc.

—Fixer and Fixing Process—

The fixer is not particularly limited and can be selected according to the purpose, and known heating and pressing means is preferably used. The heating and pressing means includes a combination of a heat roller and a pressure roller, a combination of a heat roller, a pressure roller and an endless belt.

The fixing process fixes a toner image transferred onto the recording medium, and may fix each toner (visible) image transferred thereon or layered toner images of each color at one time.

The heating and pressing means preferably heats at 80° C. to 200° C.

The fixer may be an optical fixer, and this can be used alone or in combination with the heating and pressing means.

A surface pressure in the fixing process is preferably from 10 $N/cm^2$ to 80 $N/cm^2$.

—Cleaner and Cleaning Process—

The cleaner is not limited in configuration so long as it can remove residual toner particles remaining on the electrophotographic photoconductor. Specific examples of the cleaner include, but are not limited to, magnetic brush cleaner, electrostatic brush cleaner, magnetic roller cleaner, blade cleaner, brush cleaner, and web cleaner.

The cleaning process can be performed by the cleaner, and is a process of removing residual toner particles remaining on the electrophotographic photoconductor.

—Neutralizer and Neutralization Process—

The neutralizer is not limited in configuration so long as it can apply a neutralization bias to the electrophotographic photoconductor. Specific examples of the neutralizer include, but are not limited to, a neutralization lamp.

The neutralization process can be performed by the neutralizer, and is a process of neutralizing the electrophotographic photoconductor by application of a neutralization bias thereto.

—Recycler and Recycle Process—

Specific examples of the recycler include, but are not limited to, a conveyer if it recycles the toner removed in the cleaning process in the image developer.

The recycle process can be performed by the recycler, and is a process of recycling the toner particles removed in the cleaning process in the image developer.

—Controller and Control Process—

The controller is not limited in configuration so long as it can control the above-described processes. Specific examples of the controller include, but are not limited to, a sequencer and a computer.

The control process can be performed by the controller, and is a process of controlling the above-described processes.

Figure 5:
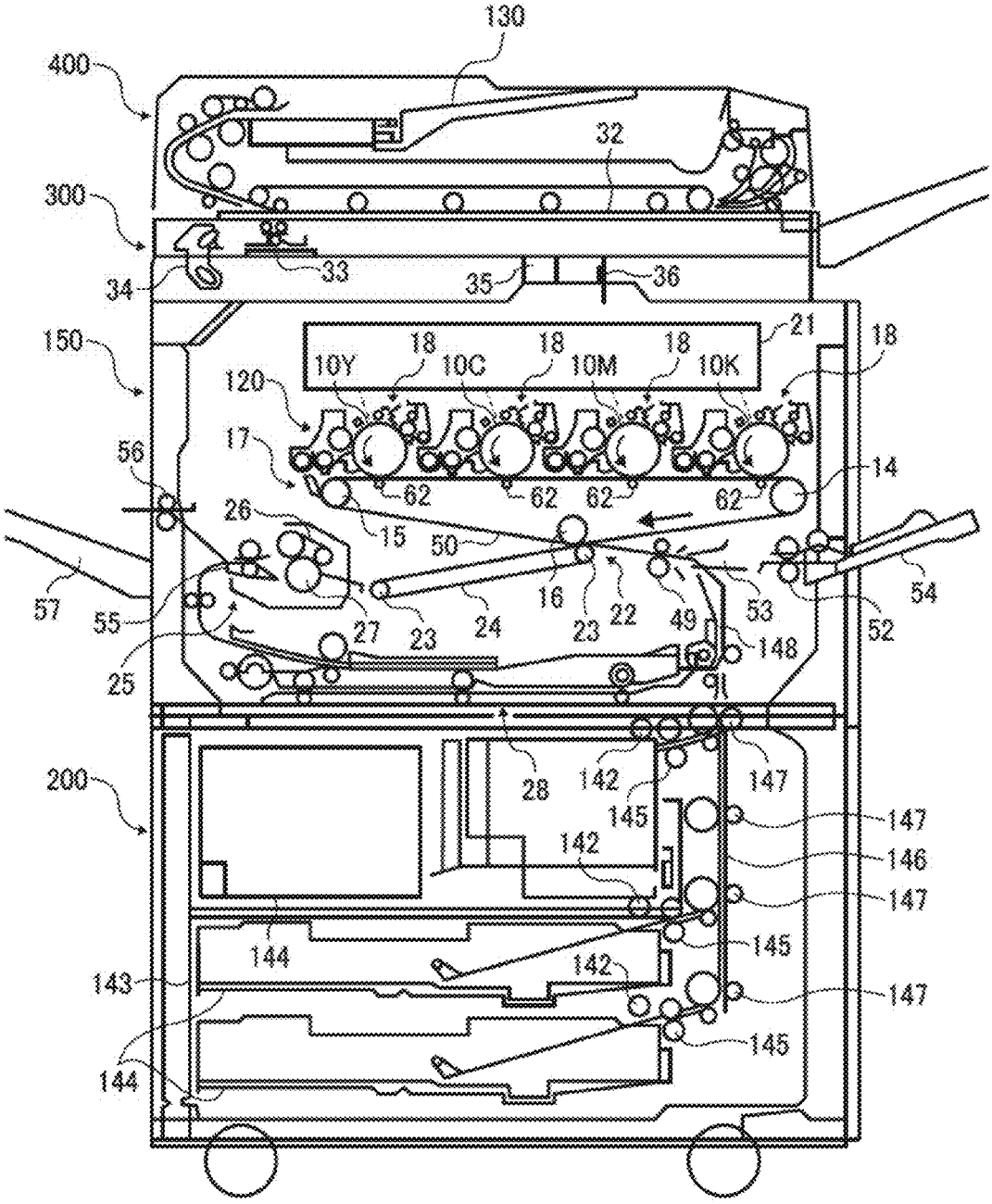
FIG. 5 is a schematic view illustrating another embodiment of the image forming apparatus of the present invention.
Figure 6:
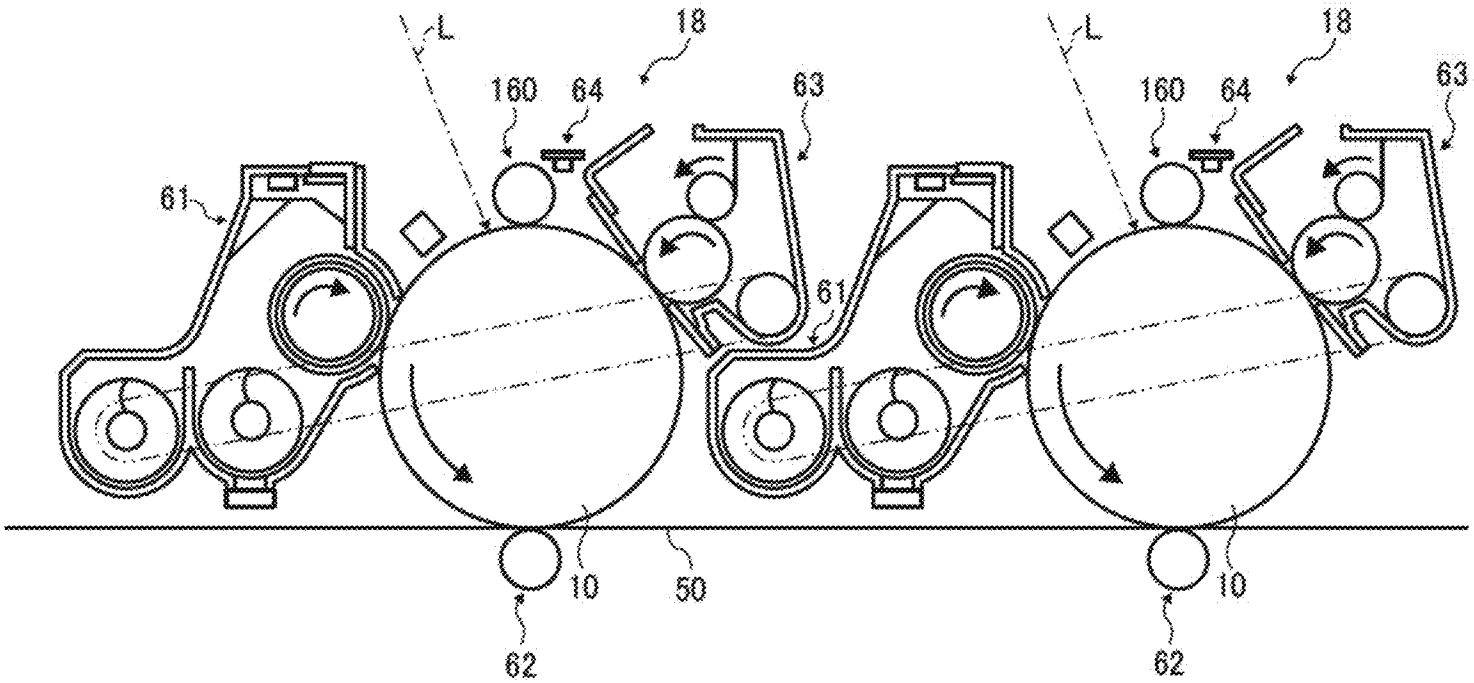
FIG. 6 is a schematic view illustrating a further embodiment of the image forming apparatus of the present invention.

An embodiment of the image forming apparatus of the present invention is explained, referring to FIGS. 5 and 6.

An image forming apparatus in FIG. 5 includes a main body 150, a paper feed table 200, a scanner 300, and an automatic document feeder (ADF) 400.

A seamless-belt shaped intermediate transferer 50 is disposed at the center of the main body 150. The intermediate transferer 50 is stretched taut with support rollers 14, 15, and 16 and is rotatable clockwise in FIG. 5. A cleaner 17 is disposed adjacent to the support roller 15 to remove residual toner particles remaining on the intermediate transferer 50. Four image forming units 18 adapted to form respective toner images of yellow, cyan, magenta, and cyan are disposed in tandem facing a surface of the intermediate transferer 50 stretched between the support rollers 14 and 15. The image forming units 18 forms a tandem image developer 120.

An irradiator 21 is disposed adjacent to the tandem image developer 120. A second transferer 22 is disposed on the opposite side of the tandem developing device 120 with respect to the intermediate transferer 50. The second transferer 22 includes a seamless secondary transfer belt 24 stretched taut with a pair of rollers 23. The second transferer 22 is configured such that the secondary transfer belt 24 conveys a recording medium while keeping the recording medium contacting the intermediate transferer 50. A fixer 25 is disposed adjacent to the second transferer 22. The fixer 25 includes a seamless fixing belt 26 and a pressing roller 27 pressed against the fixing belt 26.

A reverser 28 adapted to reverse recording medium in duplexing is disposed adjacent to the second transferer 22 and the fixing device 25.

Next, full-color image formation (color copy) using the tandem image developer 120 is explained. A document is set on a document table 130 of the automatic document feeder 400. Alternatively, a document is set on a contact glass 32 of the scanner 300 while lifting up the automatic document feeder 400, followed by holding down of the automatic document feeder 400.

Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light from a light source to the document, and reflects a light reflected from the document toward the second runner 34. A mirror in the second runner 34 reflects the light toward a reading sensor 36 through an imaging lens 35. The light is then received by a reading sensor 36. Thus, the document is read and image information of black, cyan, magenta, and yellow are obtained.

Then, each image information of black, yellow, magenta, and cyan is transmitted to corresponding image forming units 18 (black image forming unit, yellow image forming unit, magenta image forming unit, and cyan image forming unit) in the tandem type developing unit 120 to form each toner image of black, yellow, magenta, and cyan in each image forming unit.

Specifically, as illustrated in FIG. 6, each image forming unit 18 (black image forming unit, yellow image forming unit, magenta image forming unit, and cyan image forming unit) in the tandem type developing unit 120 has a latent electrostatic image bearing member 10 (black latent electrostatic image bearing member 10K, yellow latent electrostatic image bearing member 10Y, magenta latent electrostatic image bearing member 10M, and cyan latent electrostatic image bearing member 10C, a charger 60 that uniformly charges the latent electrostatic bearing member 10, an irradiator that exposes the latent electrostatic image bearing member 10 with L illustrated in FIG. 6 according to the color image information to form a latent electrostatic image corresponding to each color image on the latent electrostatic image bearing member 10, a developing unit 61 that develops the latent electrostatic image by using each color toner (black toner, yellow toner, magenta toner, and cyan toner) to form a toner image of each color toner, a transfer charger 62 as a first transferer that transfers the toner image onto the intermediate transferer 50, a cleaning device 63, and a discharger 64, to form each single color image (black image, yellow image, magenta image, and cyan image) based on each color image formation.

The black image, yellow image, magenta image, and cyan image formed in this manner, that is, the black image formed on the black latent electrostatic image carrier 10K, yellow image formed the yellow latent electrostatic image carrier 10Y, magenta image formed on the magenta latent electrostatic image bearing member 10M, and cyan image formed on the cyan latent electrostatic image bearing member 10C are transferred (primary transfer) one by one to the intermediate transferer 50 which is rotationally transferred by the support rollers 14, 15, and 16. Then, the black image, yellow image, magenta image, and cyan image are superimposed sequentially on the intermediate transferer 50 to form a synthetic color image (color transfer image).

In the paper feeding table 200, one of the paper feed rollers 142 is selectively rotated to draw a recording medium from one of multistage paper feed cassettes 144 provided in a paper bank 143. A separating roller 145 separates the recording media one by one by to feed each paper to a paper feed path 146. The recording medium is conveyed by a conveyer roller 147, introduced into a paper feed path 148 in the main body 150, strikes a registration roller 49, and is held there. Alternatively, the recording medium on a manual tray 54 is fed one by one by a separating roller 52, introduced into a manual paper feed path 53, strikes a registration roller 49, and is held there. Although the registration roller 49 is usually used in a grounded condition, a bias can be applied thereto to remove paper dust of the recording medium.

Then, the registration roller 49 feeds the recording medium between the intermediate transferer 50 and the second transferer 22 by rotating in synchronization with the synthetic color image (color transfer image) synthesized on the intermediate transferer 50. The second transferer 22 secondly transfers the synthetic color image (color transfer image) to the recording medium to form the color image thereon. Residual toner left on the intermediate transferer 50 after the image transfer is removed by the intermediate transferer cleaner 17.

The recording medium onto which the color image is transferred is conveyed by the second transferer 22 and fed to a fixer 25 including a fixing belt 26 and pressure roller 27, where the synthetic color image (color transfer image) is fixed onto the recording medium by heat and pressure. Then, the recording medium is turned by a switching claw 55, discharged by a discharge roller 56, and stuck on a paper discharge tray 57. Alternatively, the recording medium is turned by the switching claw 55, inversed by the reverser 28, introduced again into the transfer position to record an image on the backside thereof, then, discharged by the discharge roller 56, and stuck on the discharge tray 57.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

The following materials were mixed in HENSCHEL MIXER SPM from KAWATA MFG Co., Ltd.
<Materials>

| | |
|---|---|
| Polyvinylidene fluoride (Kynar 720 from Arkema) | 66 |
| Polyvinylidene fluoride copolymer (Kynar Flex 2750 from Arkema) | 17 |
| Polyether ester amide (PELECTRON AS rom Sanyo Chemical Industries, Ltd.). | 7 |
| Conductive filler A (Denka Black having an average primary particle diameter of 35 nm from DENKA DENKI KAGAKU KOGYO KABUSHIKI KAISHA | 6 |
| Conductive filler B (Toka Black #4300 having an average primary particle diameter of 55 nm from Tokai Carbon Co., Ltd. | 4 |

The resultant mixture was melted and kneaded by a biaxial kneader TEM from Toshiba Machine Co., Ltd., and pelletized by a pelletizer to obtain a pellet.

The pellet was placed in a cylindrical mold and extruded by a melting and kneading extruder to prepare a seamless belt having a circumferential length of 960 mm and a thickness of 120 μm.

An average of the common logarithm of the surface resistivity obtained by the following measurement was 11.23 (Ω/□).

Thirty-two (32) points of the seamless belt at an interval of 30 mm in a circumferential direction were measured by under an environment of 23° C. and 50% with an application bias 500V with a resistance measurer (HIRESTA URS probe from Mitsubishi Chemical Analytech Co., Ltd.) and calculated P-P (the maximum-minimum of Log (resistivity) as a deviation. When the resistance deviation is not less than 1, the seamless belt as a transfer belt for electrophotography is difficult to first transfer or second transfer at a high resistivity portion, resulting in defective images.

The mechanical strength was measured by a tensile tester AG-X from Shimadzu Corp. according to JIS K7127. The seamless belt as a transfer belt for electrophotography having a mechanical strength elasticity not greater than 1,000 Mpa may have creep and elongation, resulting in image noise and color shift when applied with a tensile strength (60 N) from inside through a roller.

Examples 2 to 4 and Comparative Examples 1 to 5

The procedures for preparation and evaluation of the seamless belt in Example 1 were repeated except for changing the contents and ratios thereof as shown in Table 1.

The compositions and the results of the evaluation of the above seamless belts are shown in Table 1. Copolymer Ratio in Table 1 is % by weight of the copolymer based on total weight of the thermoplastic resin in the sea portion.

TABLE 1

| | Thermoplastic Resin | | | | | | |
|---|---|---|---|---|---|---|---|
| | Sea Portion | | | | | Island Portion | |
| | Name | Content | Name | Content | Copolymer Ratio | Name | Content |
| Example 1 | Polyvinylidene fluoride Kynar 720 | 66 | Polyvinylidene fluoride copolymer Kynar Flex 2750 | 17 | 20 | Polyether ester amide PELECTRON AS | 7 |
| Example 2 | Polyvinylidene fluoride Kynar 720 | 48 | Polyvinylidene fluoride copolymer Kynar Flex 2750 | 35 | 42 | Polyether ester amide PELECTRON AS | 7 |
| Example 3 | Polyvinylidene fluoride Kynar 720 | 33 | Polyvinylidene fluoride copolymer Kynar Flex 2750 | 50 | 60 | Polyether ester amide PELECTRON AS | 7 |
| Example 4 | Polyvinylidene fluoride Kynar 720 | 63 | Polyvinylidene fluoride copolymer Kynar Flex 2750 | 20 | 24 | Polyether ester amide PELECTRON AS | 7 |
| Comparative Example 1 | Polyvinylidene fluoride Kynar 720 | 73 | Polyvinylidene fluoride copolymer Kynar Flex 2750 | 10 | 12 | Polyether ester amide PELECTRON AS | 7 |
| Comparative Example 2 | Polyvinylidene fluoride Kynar 720 | 25 | Polyvinylidene fluoride copolymer Kynar Flex 2750 | 58 | 70 | Polyether ester amide PELECTRON AS | 7 |
| Comparative Example 3 | Polyvinylidene fluoride Kynar 720 | 68 | Polyvinylidene fluoride copolymer Kynar Flex 2750 | 15 | 18 | Polyether ester amide PELECTRON AS | 7 |

TABLE 1-continued

| | | | | | | | |
|---|---|---|---|---|---|---|---|
| Comparative Example 4 | Polyvinylidene fluoride Kynar 720 | 68 | Polyvinylidene fluoride copolymer Kynar Flex 2750 | 15 | 18 | Polyether ester amide PELECTRON AS | 7 |
| Comparative Example 5 | Polyvinylidene fluoride Kynar 720 | 68 | Polyvinylidene fluoride copolymer Kynar Flex 2750 | 15 | 18 | Polyether ester amide PELECTRON AS | 7 |

| | Conductive Filler | | | | | | |
|---|---|---|---|---|---|---|---|
| | A | | | B | | | |
| | Name | Average Primary Particle Diameter | Content | Name | Average Primary Particle Diameter | Content | B/A |
| Example 1 | Denka Black | 35 nm | 6 | Toka Black #4300 | 55 nm | 4 | 1.57 |
| Example 2 | Denka Black | 35 nm | 6 | Toka Black #4300 | 55 nm | 4 | 1.57 |
| Example 3 | Denka Black | 35 nm | 6 | Toka Black #4300 | 55 nm | 4 | 1.57 |
| Example 4 | Denka Black | 35 nm | 6 | Toka Black #4300 | 55 nm | 4 | 1.57 |
| Comparative Example 1 | Denka Black | 35 nm | 6 | Toka Black #4300 | 55 nm | 4 | 1.57 |
| Comparative Example 2 | Denka Black | 35 nm | 6 | Toka Black #4300 | 55 nm | 4 | 1.57 |
| Comparative Example 3 | Denka Black | 35 nm | 8 | — | — | — | — |
| Comparative Example 4 | Denka Black | 35 nm | 6 | Mitsubishi Carbon Black #25 | 47 nm | 4 | 1.34 |
| Comparative Example 5 | Mitsubishi Carbon Black #40 | 24 nm | 6 | N990 Thermal Black | 280 nm | 4 | 11.67 |

| | Evaluation | |
|---|---|---|
| | Resistance Deviation 500 V | Mechanical Strength Elasticity (Mpa) |
| Example 1 | 0.9 | 1500 |
| Example 2 | 0.8 | 1200 |
| Example 3 | 0.7 | 800 |
| Example 4 | 0.8 | 1800 |
| Comparative Example 1 | 1.2 | 1700 |
| Comparative Example 2 | 1.1 | 500 |
| Comparative Example 3 | 1.3 | 1700 |
| Comparative Example 4 | 1.2 | 1700 |
| Comparative Example 5 | 1.3 | 1800 |

Example 5

The following materials 1 were mixed in HENSCHEL MIXER SPM from KAWATA MFG Co., Ltd.

<Materials 1>

| | |
|---|---|
| Polyvinylidene fluoride (Kynar 720 from Arkema) | 35 |
| Polyvinylidene fluoride copolymer (Kynar Flex 2750 from Arkema) | 10 |
| Polyether ester amide (PELECTRON AS rom Sanyo Chemical Industries, Ltd.). | 7 |
| Conductive filler A (Denka Black having an average primary particle diameter of 35 nm from DENKA DENKI KAGAKU KOGYO KABUSHIKI KAISHA | 6 |

The resultant mixture was melted and kneaded by a biaxial kneader TEM from Toshiba Machine Co., Ltd., and pelletized by a pelletizer to obtain a pellet A.

The following materials 2 were mixed in HENSCHEL MIXER SPM from KAWATA MFG Co., Ltd.

<Materials 2>

| | |
|---|---|
| Polyvinylidene fluoride (Kynar 720 from Arkema) | 28 |
| Polyvinylidene fluoride copolymer (Kynar Flex 2750 from Arkema) | 10 |
| Conductive filler B (Toka Black #4300 having an average primary particle diameter of 55 nm from Tokai Carbon Co., Ltd. | 4 |

The resultant mixture was melted and kneaded by a biaxial kneader TEM from Toshiba Machine Co., Ltd., and pelletized by a pelletizer to obtain a pellet B.

Next, 58 parts by weight of the pellet A and 42 parts by weight of the pellet B were mixed, and the mixture was placed in a cylindrical mold and extruded by a melting and kneading extruder to prepare a seamless belt having a circumferential length of 960 mm and a thickness of 120 μm. The seamless belt was measured and evaluated in the same manner as in Example 1. An average of the common logarithm of the surface resistivity was 11.12 (Ω/□).

A cross section of the seamless belt was formed by ion milling, and a presence (an areal) ratio of the conductive filler in the thermoplastic resin in the island portion was determined by an SEM. The areal ratio of the conductive filler in the island portion was determined on the basis of total area of the conductive filler in both of the island portion and the sea portion.

Example 6

The following materials 1 were mixed in HENSCHEL MIXER SPM from KAWATA MFG Co., Ltd.

<Materials 1>

| | |
|---|---|
| Polyvinylidene fluoride (Kynar 720 from Arkema) | 25 |
| Polyvinylidene fluoride copolymer (Kynar Flex 2750 from Arkema) | 10 |
| Polyether ester amide (PELECTRON AS rom Sanyo Chemical Industries, Ltd.). | 7 |
| Conductive filler A (Denka Black having an average primary particle diameter of 35 nm from DENKA DENKI KAGAKU KOGYO KABUSHIKI KAISHA | 6 |

The resultant mixture was melted and kneaded by a biaxial kneader TEM from Toshiba Machine Co., Ltd., and pelletized by a pelletizer to obtain a pellet A.

The following materials 2 were mixed in HENSCHEL MIXER SPM from KAWATA MFG Co., Ltd.

<Materials 2>

| | |
|---|---|
| Polyvinylidene fluoride (Kynar 720 from Arkema) | 38 |
| Polyvinylidene fluoride copolymer (Kynar Flex 2750 from Arkema) | 10 |
| Conductive filler B (Toka Black #4300 having an average primary particle diameter of 55 nm from Tokai Carbon Co., Ltd. | 4 |

The resultant mixture was melted and kneaded by a biaxial kneader TEM from Toshiba Machine Co., Ltd., and pelletized by a pelletizer to obtain a pellet B.

Next, 48 parts by weight of the pellet A and 52 parts by weight of the pellet B were mixed, and the mixture was placed in a cylindrical mold and extruded by a melting and kneading extruder to prepare a seamless belt having a circumferential length of 960 mm and a thickness of 120 μm. The seamless belt was measured and evaluated in the same manner as in Example 5. An average of the common logarithm of the surface resistivity was 11.21 (Ω/□).

Example 7

The following materials 1 were mixed in HENSCHEL MIXER SPM from KAWATA MFG Co., Ltd.

<Materials 1>

| | |
|---|---|
| Polyvinylidene fluoride (Kynar 720 from Arkema) | 15 |
| Polyvinylidene fluoride copolymer (Kynar Flex 2750 from Arkema) | 10 |
| Polyether ester amide (PELECTRON AS rom Sanyo Chemical Industries, Ltd.). | 7 |
| Conductive filler A (Denka Black having an average primary particle diameter of 35 nm from DENKA DENKI KAGAKU KOGYO KABUSHIKI KAISHA | 6 |

The resultant mixture was melted and kneaded by a biaxial kneader TEM from Toshiba Machine Co., Ltd., and pelletized by a pelletizer to obtain a pellet A.

The following materials 2 were mixed in HENSCHEL MIXER SPM from KAWATA MFG Co., Ltd.

<Materials 2>

| | |
|---|---|
| Polyvinylidene fluoride (Kynar 720 from Arkema) | 48 |
| Polyvinylidene fluoride copolymer (Kynar Flex 2750 from Arkema) | 10 |
| Conductive filler B (Toka Black #4300 having an average primary particle diameter of 55 nm from Tokai Carbon Co., Ltd. | 4 |

The resultant mixture was melted and kneaded by a biaxial kneader TEM from Toshiba Machine Co., Ltd., and pelletized by a pelletizer to obtain a pellet B.

Next, 38 parts by weight of the pellet A and 62 parts by weight of the pellet B were mixed, and the mixture was placed in a cylindrical mold and extruded by a melting and kneading extruder to prepare a seamless belt having a circumferential length of 960 mm and a thickness of 120 μm. The seamless belt was measured and evaluated in the same manner as in Example 5. An average of the common logarithm of the surface resistivity was 11.38 (Ω/□).

Example 8

The procedure for preparation of the seamless belt in Example 1 was repeated except for replacing the copolymer Kynar Flex 2750 (HFP 15%) with a copolymer Kynar Flex 2820 (HFP 10%). HFP % represents a presence ratio of hexafluoropropylene in the copolymer. The seamless belt was measured and evaluated in the same manner as in Example 5.

Example 9

The following materials 1 were mixed in HENSCHEL MIXER SPM from KAWATA MFG Co., Ltd.

<Materials 1>

| | |
|---|---|
| Polyvinylidene fluoride (Kynar 720 from Arkema) | 30 |
| Polyvinylidene fluoride copolymer (Kynar Flex 2820 from Arkema) | 7 |
| Polyether ester amide (PELECTRON AS from Sanyo Chemical Industries, Ltd.) | 7 |
| Conductive filler A (Denka Black having an average primary particle diameter of 35 nm from DENKA DENKI KAGAKU KOGYO KABUSHIKI KAISHA | 6 |

The resultant mixture was melted and kneaded by a biaxial kneader TEM from Toshiba Machine Co., Ltd., and pelletized by a pelletizer to obtain a pellet A.

The following materials 2 were mixed in HENSCHEL MIXER SPM from KAWATA MFG Co., Ltd.

<Materials 2>

| | |
|---|---|
| Polyvinylidene fluoride (Kynar 720 from Arkema) | 36 |
| Polyvinylidene fluoride copolymer (Kynar Flex 2820 from Arkema) | 10 |
| Conductive filler B (Toka Black #4300 having an average primary particle diameter of 55 nm from Tokai Carbon Co., Ltd. | 4 |

The resultant mixture was melted and kneaded by a biaxial kneader TEM from Toshiba Machine Co., Ltd., and pelletized by a pelletizer to obtain a pellet B.

Next, 50 parts by weight of the pellet A and 50 parts by weight of the pellet B were mixed, and the mixture was placed in a cylindrical mold and extruded by a melting and kneading extruder to prepare a seamless belt having a circumferential length of 960 mm and a thickness of 120 μm. The seamless belt was measures and evaluated in the same manner as in Example 5. An average of the common logarithm of the surface resistivity was 11.32 (Ω/□). The following Table 2 proves the resistance deviation was improved.

Example 10

The procedure for preparation of the seamless belt in Example 1 was repeated except for replacing the copolymer Kynar Flex 2750 (HFP 15%) with a copolymer Kynar Flex 2850 (HFP 5%). The seamless belt was measured and evaluated in the same manner as in Example 5. The following Table 2 proves the resistance deviation was improved further than Example 1.

Example 11

The procedure for preparation of the seamless belt in Example 10 was repeated except for replacing the homopolymer Kynar 720 with a homopolymer Kynar 710. The seamless belt was measured and evaluated in the same manner as in Example 5. The following Table 2 proves the resistance deviation was improved further than Example 1.

Example 12

The procedure for preparation of the seamless belt in Example 10 was repeated except for replacing the homopolymer Kynar 720 with a homopolymer Kynar 760. The seamless belt was measured and evaluated in the same manner as in Example 5. The following Table 2 proves the resistance deviation was improved further than Example 1.

A weight-average molecular weight (Mw) of the polyvinylidene fluoride was measured by gel permeation chromatography (GPC). N-methyl-pyrrolidone (NMP) was used as a solvent. The results were as follows.

Kynar 710: Mw=71,000
Kynar 720: Mw=150,000
Kynar 740: Mw=250,000
Kynar 760: Mw=441,000
Kynar 761A: Mw=570,000

The compositions and the results of the evaluation of the above seamless belts are shown in Table 2.

TABLE 2

| | Thermoplastic Resin | | | | | | |
|---|---|---|---|---|---|---|---|
| | Sea Portion | | | | | Island Portion | |
| | Name | Content | Name | Content | Copolymer Ratio | Name | Content |
| Example 5 | Polyvinylidene fluoride Kynar 720 | 66 | Polyvinylidene fluoride copolymer Kynar Flex 2750 | 17 | 20 | Polyether ester amide PELECTRON AS | 7 |
| Example 6 | Polyvinylidene fluoride Kynar 720 | 66 | Polyvinylidene fluoride copolymer Kynar Flex 2750 | 17 | 20 | Polyether ester amide PELECTRON AS | 7 |
| Example 7 | Polyvinylidene fluoride Kynar 720 | 66 | Polyvinylidene fluoride copolymer Kynar Flex 2750 | 17 | 20 | Polyether ester amide PELECTRON AS | 7 |
| Example 8 | Polyvinylidene fluoride Kynar 720 | 66 | Polyvinylidene fluoride copolymer Kynar Flex 2820 (Tm 142° C.) | 17 | 20 | Polyether ester amide PELECTRON AS | 7 |
| Example 9 | Polyvinylidene fluoride Kynar 720 | 66 | Polyvinylidene fluoride copolymer Kynar Flex 2820 (Tm 142° C., HFP 10%) | 17 | 20 | Polyether ester amide PELECTRON AS | 7 |
| Example 10 | Polyvinylidene fluoride Kynar 720 | 66 | Polyvinylidene fluoride copolymer Kynar Flex 2850 (Tm 156° C., HFP 5%) | 17 | 20 | Polyether ester amide PELECTRON AS | 7 |
| Example 11 | Polyvinylidene fluoride Kynar 710 | 66 | Polyvinylidene fluoride copolymer Kynar Flex 2850 (Tm 156° C., HFP 5%) | 17 | 20 | Polyether ester amide PELECTRON AS | 7 |

TABLE 2-continued

| | | | | | | | |
|---|---|---|---|---|---|---|---|
| Example 12 | Polyvinylidene fluoride Kynar 760 | 66 | Polyvinylidene fluoride copolymer Kynar Flex 2850 (Tm 156° C., HFP 5%) | 17 | 20 | Polyether ester amide PELECTRON AS | 7 |

| | Conductive Filler | | | | | | |
|---|---|---|---|---|---|---|---|
| | A | | | B | | | |
| | Name | Average Primary Particle Diameter | Content | Name | Average Primary Particle Diameter | Content | B/A |
| Example 5 | Denka Black | 35 nm | 6 | Toka Black #4300 | 55 nm | 4 | 1.57 |
| Example 6 | Denka Black | 35 nm | 6 | Toka Black #4300 | 55 nm | 4 | 1.57 |
| Example 7 | Denka Black | 35 nm | 6 | Toka Black #4300 | 55 nm | 4 | 1.57 |
| Example 8 | Denka Black | 35 nm | 6 | Toka Black #4300 | 55 nm | 4 | 1.57 |
| Example 9 | Denka Black | 35 nm | 6 | Toka Black #4300 | 55 nm | 4 | 1.57 |
| Example 10 | Denka Black | 35 nm | 6 | Toka Black #4300 | 55 nm | 4 | 1.57 |
| Example 11 | Denka Black | 35 nm | 6 | Toka Black #4300 | 55 nm | 4 | 1.57 |
| Example 12 | Denka Black | 35 nm | 6 | Toka Black #4300 | 55 nm | 4 | 1.57 |

| | Evaluation | | |
|---|---|---|---|
| | Resistance Deviation 500 V | Mechanical Strength Elasticity (Mpa) | Areal Ratio |
| Example 5 | 0.5 | 1800 | 25 |
| Example 6 | 0.5 | 1800 | 45 |
| Example 7 | 0.5 | 1800 | 60 |
| Example 8 | 0.8 | 1800 | 25 |
| Example 9 | 0.4 | 1800 | 25 |
| Example 10 | 0.6 | 1800 | 25 |
| Example 11 | 0.6 | 1600 | 25 |
| Example 12 | 0.6 | 1600 | 25 |

Reference Example 1

The following bleed evaluation was made on Example 10. A saturated moisture absorption (23° C. 50% RH, moisture absorption time 48 hrs) of PELECTRON AS was not less than 3% when measured by Karl Fischer moisture meter (vaporization temperature 160° C.). When not less than 3%, the belt was hydrolyzed when molded, and a polyalkylene unit had lower molecular weight, resulting in bleed out in the following storage test. In this case, productivity was low because the belt was fully dried by heated air (95° C./6 hrs), and molding needed low temperature, low humidity and nitrogen substitution.

The bleed out evaluation was made by leaving the belt at 45° C. 95% RH for 14 days to visually observe whether bleed out occurs on the surface thereof.

Poor: Bleed out occurred

Fair: No bleed out by drying with heated air

Good: No bleed out

Example 13

The procedure for preparation of the seamless belt in Example 10 was repeated except for replacing PELECTRON AS with PELECTRON HS (from Sanyo Chemical Industries, Ltd.). The seamless belt was measured and evaluated in the same manner as in Reference Example 1. PELECTRON HS had a saturated moisture absorption about 2%.

Example 14

The procedure for preparation of the seamless belt in Example 13 was repeated except for replacing PELECTRON HS with PELECTRON PVH (from Sanyo Chemical Industries, Ltd.). The seamless belt was measured and evaluated in the same manner as in Example 13. PELECTRON PVH had a saturated moisture absorption of 2%.

Table 3 shows the belt of Example 14 had considerably a small resistance deviation of 0.3. It is thought this is because PELECTRON PVH is polyether ester olefin comparatively compatible with polyvinylidene fluoride (PVDF), not completely though.

The compositions and the results of the evaluation of the above seamless belts are shown in Table 3.

TABLE 3

| | Thermoplastic Resin | | | | | | |
|---|---|---|---|---|---|---|---|
| | Sea Portion | | | | | Island Portion | |
| | Name | Content | Name | Content | Copolymer Ratio | Name | Content |
| Reference Example 1 | Polyvinylidene fluoride Kynar 720 | 66 | Polyvinylidene fluoride copolymer Kynar Flex 2850 (Tm 156° C., HFP 5%) | 17 | 20 | Polyether ester amide PELECTRON AS | 7 |
| Example 13 | Polyvinylidene fluoride Kynar 720 | 66 | Polyvinylidene fluoride copolymer Kynar Flex 2750 | 17 | 20 | Polyether olefin copolymer PELECTRON HS | 7 |
| Example 14 | Polyvinylidene fluoride Kynar 720 | 66 | Polyvinylidene fluoride copolymer Kynar Flex 2750 | 17 | 20 | Polyether ester olefin PELECTRON PVH | 7 |

| | Conductive Filler | | | | | | |
|---|---|---|---|---|---|---|---|
| | A | | | B | | | |
| | Name | Average Primary Particle Diameter | Content | Name | Average Primary Particle Diameter | Content | B/A |
| Reference Example 1 | Denka Black | 35 nm | 6 | Toka Black #4300 | 55 nm | 4 | 1.57 |
| Example 13 | Denka Black | 35 nm | 6 | Toka Black #4300 | 55 nm | 4 | 1.57 |
| Example 14 | Denka Black | 35 nm | 6 | Toka Black #4300 | 55 nm | 4 | 1.57 |

| | Evaluation | | | |
|---|---|---|---|---|
| | Resistance Deviation 500 V | Mechanical Strength Elasticity (Mpa) | Areal Ratio | Bleed |
| Example 5 | 0.6 | 1800 | 25 | Fair |
| Example 6 | 0.6 | 1800 | 25 | Good |
| Example 7 | 0.3 | 1800 | 25 | Good |

Having now fully described the invention, it will be apparent to one of ordinary skill in the art that many changes and modifications can be made thereto without departing from the spirit and scope of the invention as set forth therein.

What is claimed is:

1. A semiconductive resin composition, comprising:

a plurality of thermoplastic resins forming a sea-island structure including a sea portion and an island portion; and a plurality of conductive fillers, wherein the sea portion includes at least two of the thermoplastic resins, at least one of the at least two of the thermoplastic resins is a copolymer, and the content of the copolymer is from 20% to 60% by weight per 100% by weight of the thermoplastic resins in the sea portion, and wherein one conductive filler amongst the plurality of conductive fillers is constituted by particles and has average primary particle diameter A that is smallest amongst those of the plurality of conductive fillers, and another conductive filler amongst the plurality of conductive fillers is constituted by particles and has average primary particle diameter B that is largest amongst those of the plurality of conductive fillers, and wherein the average primary particle diameter A of said one conductive filler that is constituted by particles and the average primary particle diameter B of said another conductive filler that is constituted by particles satisfy the following relation:

$$1.5 \leq B/A \leq 10.$$

2. The semiconductive resin composition of claim 1, wherein the plurality of conductive fillers are disbursed in both the sea portion and the island portion of the sea-island structure of the thermoplastic resin, and the conductive fillers present in the sea portion accounts for 25% to 60% of all the conductive fillers in terms of cross-sectional areal ratio, said cross-section areal ratio being a ratio of an area occupied by the conductive filler in the island portion to an area occupied by the conductive filler in both of the sea portion and the island portion.

3. The semiconductive resin composition of claim 1, wherein one of the thermoplastic resins in the sea portion is a polyvinylidene fluoride, and wherein the copolymer comprises:

vinylidene fluoride structural units; and hexafluoropropylene structural units in an amount of from 5% to 10% by mol per 100% by mol of the copolymer.

4. The semiconductive resin composition of claim 3, wherein the copolymer has a melting point of from 140° C. to 160° C.

5. The semiconductive resin composition of claim 3, wherein the polyvinylidene fluoride has a weight-average molecular weight of from 100,000 to 500,000.

6. The semiconductive resin composition of claim 1, wherein the thermoplastic resin in the island portion is a block copolymer having a polyalkylene unit and has a saturated moisture absorption quantity not greater than 3%.

7. The semiconductive resin composition of claim 6, wherein the polyalkylene unit comprises a polypropylene.

8. A seamless belt for use in electrophotography, comprising:

the semiconductive resin composition according to claim 1.

9. An image forming apparatus, comprising:

an electrostatic latent image bearer;

an electrostatic latent image former to form an electrostatic latent image on the electrostatic latent image bearer;

an image developer to develop the electrostatic latent image with a toner to form a visible image;

a transferer to transfer the visible image onto a recording medium; and the seamless belt according to claim 8.

* * * * *